United States Patent [19]

Poli

[11] Patent Number: 5,052,205

[45] Date of Patent: Oct. 1, 1991

[54] LOCK CYLINDER HAVING A SLIDE PLATE WITH ONE OR MORE ROWS OF PIN TUMBLERS AND KEY THEREFOR

[76] Inventor: Julio Poli, Presidente Riesco 6445, Depto. 502, Las Condes, Santiago, Chile

[21] Appl. No.: 569,138

[22] Filed: Aug. 17, 1990

[51] Int. Cl.[5] ..... E05B 27/04

[52] U.S. Cl. ..... 70/360; 70/386; 70/495

[58] Field of Search ..... 70/360, 361, 386, 494–496

[56] References Cited

U.S. PATENT DOCUMENTS

| | | | |
|---|---|---|---|
| 1,965,889 | 7/1934 | Fitzgerald | 70/495 X |
| 2,023,847 | 12/1935 | Liss | 70/494 |
| 2,287,175 | 6/1942 | Heyer | 70/495 |
| 3,733,863 | 5/1973 | Toepfer | 70/496 |
| 3,877,267 | 4/1975 | Harris, Jr. | 70/495 X |
| 4,434,636 | 3/1984 | Prunbauer | 70/495 X |
| 4,759,204 | 7/1988 | Neyret | 70/360 |

FOREIGN PATENT DOCUMENTS

| | | | |
|---|---|---|---|
| 0237799 | 9/1987 | European Pat. Off. | 70/495 |
| 294420 | 10/1916 | Fed. Rep. of Germany | 70/495 |

*Primary Examiner*—Lloyd A. Gall

*Attorney, Agent, or Firm*—Cushman, Darby & Cushman

[57] ABSTRACT

The disclosure relates to a locking cylinder and a key therefor. The locking cylinder has a flat slide plate and at least one pin tumbler for selectively engaging a corresponding recess in a key inserted into the lock. Insertion of the proper key which results in displacement of the pin tumbler allows longitudinal sliding movement of the flat slide plate within the cylinder lock. Sliding movement of the flat plate aligns the side edges of the flat plate with side bar pins so that, following such longitudinal displacement, the body of the cylinder can be rotated relative to its housing to effect a locking or unlocking of the lock mechanism.

12 Claims, 12 Drawing Sheets

FIG. 2
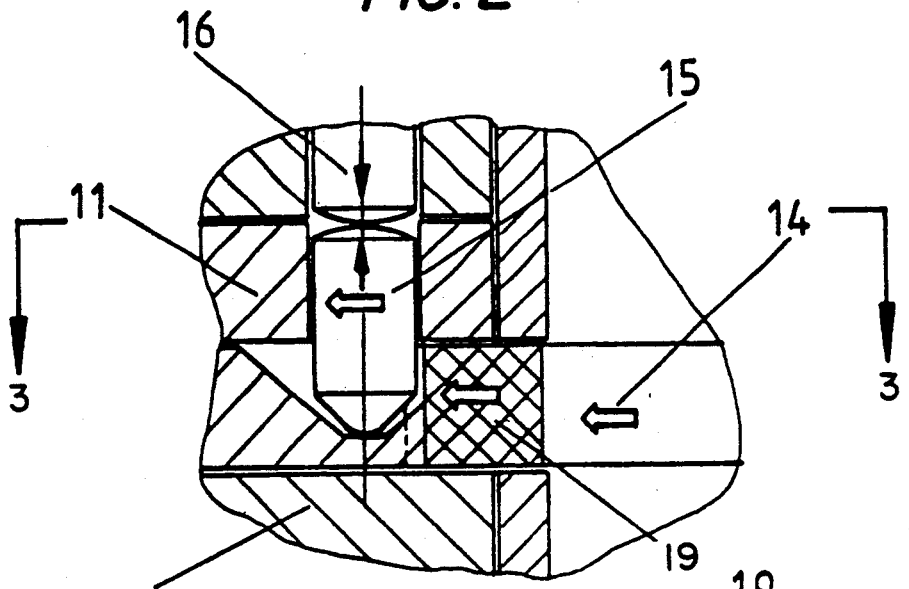
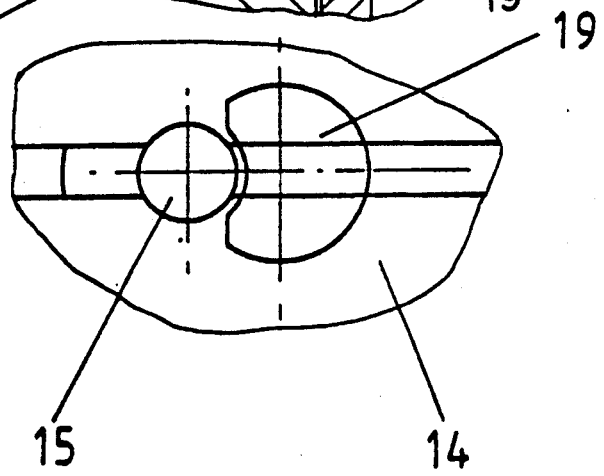
FIG. 3

FIG. 9
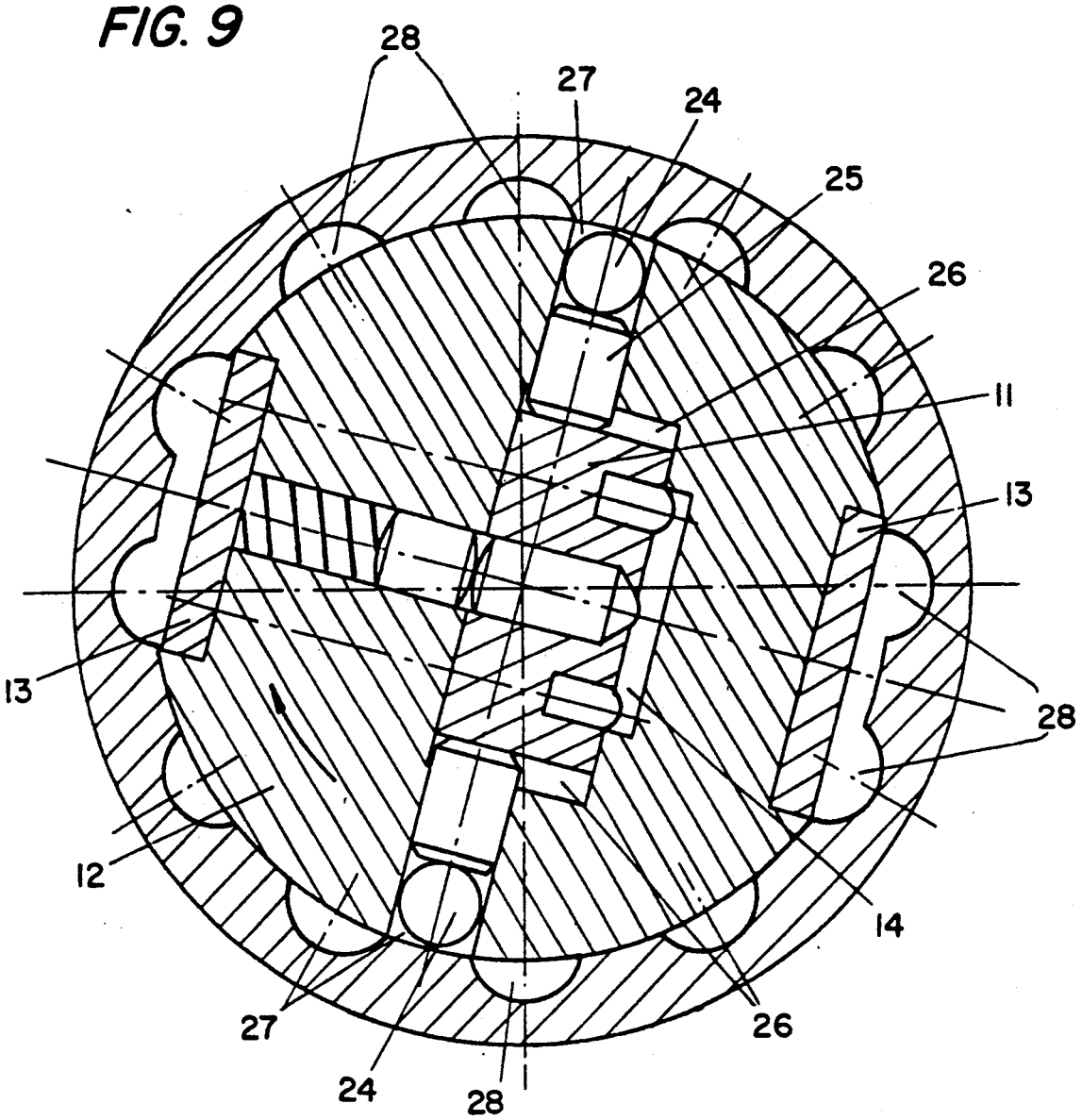
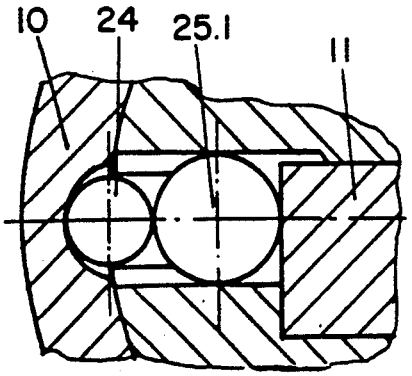
FIG. 10
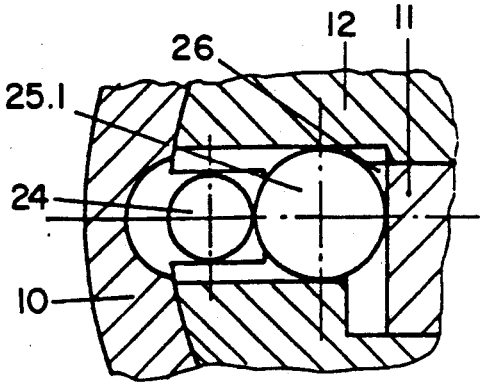
FIG. 11

LOCK CYLINDER HAVING A SLIDE PLATE WITH ONE OR MORE ROWS OF PIN TUMBLERS AND KEY THEREFOR

BACKGROUND OF THE INVENTION

1. Field of the Invention

The present invention relates to a cylinder lock having a flat slide plate with at least one hole for receiving pin tumblers and at least one indent for receiving side bar pins.

2. Description of the Related Art

The idea of designing a cylinder lock with pin tumblers, driver tumblers having a constant pressure from a spring, and using a key to make the pin tumblers align with the surface of a plug in order to free it and let it rotate have been known since they were discovered by Linius Yale late in the last century.

In fact, a very similar system was used in the old Egyptian culture which included wood pins, drivers, and a key. Of course, that ancient lock was considerably larger than that designed by Mr. Yale.

Following the above-noted early developments, a German company known as DOM created a new cylinder in which, instead of having the key bitings on the upper part, they were put into its flat surface.

Since that time, a great deal of effort has been devoted to developing a system to open the Yale-type cylinder like pinning, vibration, and the like. Because of such problems, lock manufacturers have developed special systems in order to make opening the cylinder more difficult. For example, Medeco considerably improved the security of his cylinder by means of making the pins turn in order to allow a side-bar to reach the opening position. Schlague developed a "finger pins" cylinder. Even further, Valerio Poli, the father of the inventor of the subject invention, in late 1965 developed a cylinder in which four pin tumblers faced another four pin tumblers and received a U.S. Patent therefor. Thus, various top security cylinders have been developed over the past several years.

SUMMARY OF THE INVENTION

The present invention is embodied in a lock and key. The cylinder portion of the subject invention has components which are different from standard cylinders. Indeed, standard cylinders are composed of a rotating plug and a main body or shell which does not move. The cylinder in accordance with the present invention has a flat slide plate rather than a rotating plug, a main rotating body provided with a steel armor and an external body or shell which does not rotate and can be considered as an armor.

The key of the invention has a special profile which faces the pin tumbler rows. In the upper face of the key, cuts are provided which form a profile and include several round depressions which are the equivalent of the bitings of standard keys and an insert which allows the key to push one of the pin tumblers and thus slide the plate of the cylinder portion.

In accordance with the present invention which includes the features generally described above, a strong cylinder is provided having a double armor, a flat slide plate including, for example, 13 pins, and two side bars which are operated by the flat slide plate and which thereby makes opening the lock by means other than with the particular key impossible. However, the locking cylinder of the invention can be adapted to be used with a master-key.

Other objects, features, and characteristics of the present invention, as well as the methods of operation and functions of the related elements of the structure, and the combination of parts and economies of manufacture, will become more apparent upon consideration of the following detailed description and the appended claims with reference to the accompanying drawings all of which form a part of this specification, wherein like reference numerals designate corresponding parts in the various figures.

BRIEF DESCRIPTION OF THE DRAWINGS

FIG. 2 is an enlarged view of an encircled portion of FIG. 1;

FIG. 3 is a view taken along line 3—3 of FIG. 2;

FIG. 9 is a cross-sectional view similar to the view along line 5—5 in FIG. 4 but showing a cylinder embodying a multiple close mode in accordance with the invention;

FIG. 10 is a detailed sectional view of the side bar in accordance with the invention in its locking position held by a side bar ball;

FIG. 11 is a detailed view of the side bar in its open position,, held by a side bar ball;

DETAILED DESCRIPTION OF THE PRESENTLY PREFERRED EXEMPLARY EMBODIMENTS

Figure 1:
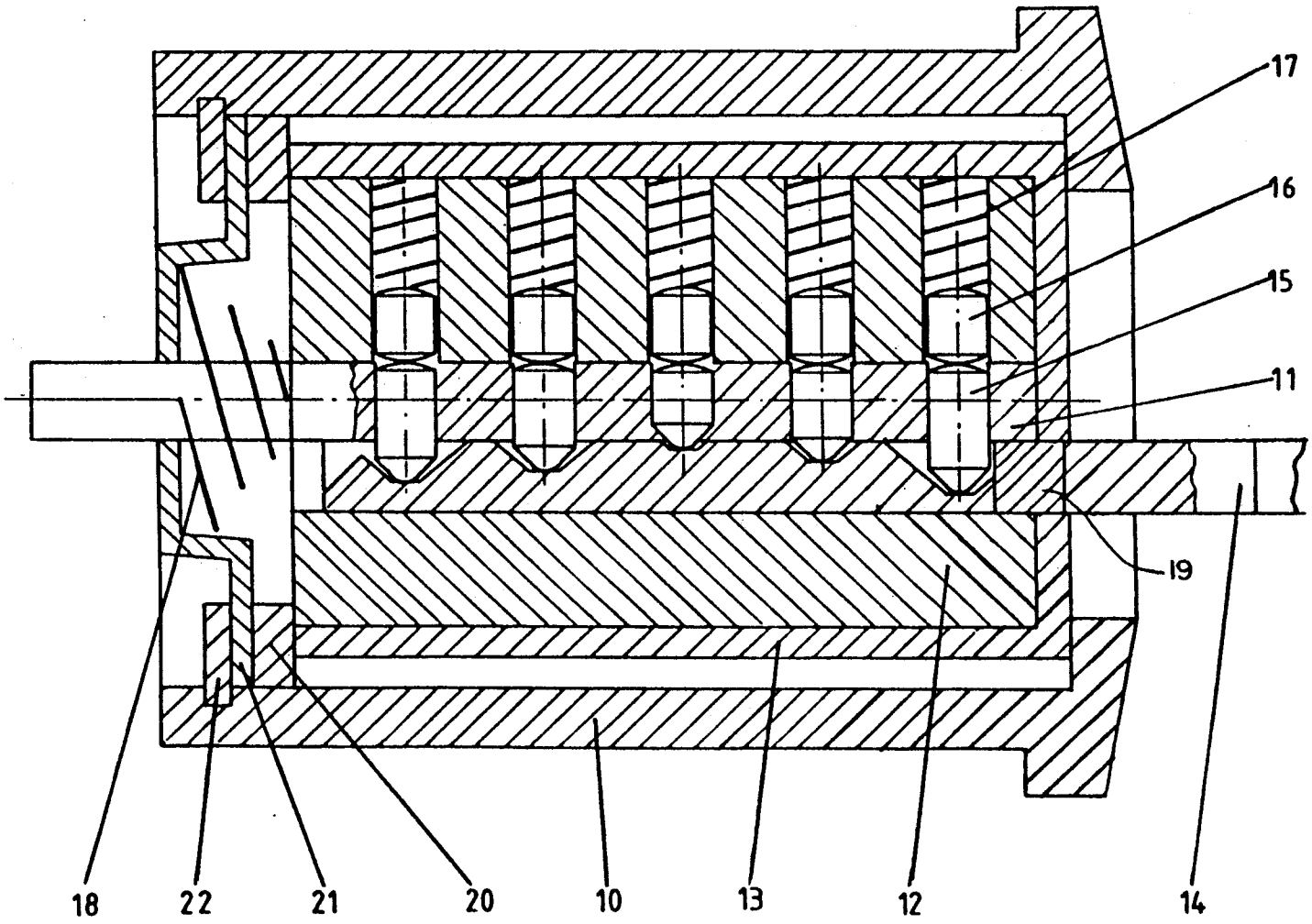
FIG. 1 is an elevational view partly in cross-section of a cylinder provided in accordance with the present invention shown in a lock position with the correct key inserted therewithin.

A cylinder in accordance with the invention is shown in FIG. 1. The cylinder includes a cylinder shell 10, which may take various other well known shapes such as rim lock shell, mortise lock shell, etc. A main rotatable body 12 preferably having a steel armor 13 is disposed within cylinder shell 10. Driver springs 17, drivers 16, flat slide plate 11 and pin tumblers 15 are all disposed within rotatable body 12 and are aligned in an opening position when the right key is inserted. More particular, when the correct key has been inserted into the cylinder lock, pins 15 and drivers 16 displace under the influence of springs 17 so as to be in alignment with a surface defined between flat slide plate 11 and the main rotatable body 12. Once the pins and drivers have been aligned in this manner upon initial insertion of the proper key, further insertion of the key causes key insert 19 to engage a pin tumbler 15 and push the same to the left as shown in FIGS. 2 and 3. Because the pins and drivers have moved so as to define a slide surface between slide plate 11 and main rotatable body 12, movement of the key insert 19 is transferred to the flat slide plate 11. If the incorrect key is fitted, then pins 15 and/or drivers 16 will impede relative sliding movement.

As is apparent, then, a pushing movement which is simultaneous with the correct alignment of pins and drivers moves the flat slide plate from the lock position shown in FIG. 1 to an open position shown particularly in FIG. 4 and described below with reference thereto.

As further shown in FIG. 1, a spring 18 is provided to urge flat slide plate 11 to the right into its lock position. A separator ring 20 defines a chamber for spring 18. A back cover 21 is further provided and is fixed by a seager ring 22.

Figure 4:
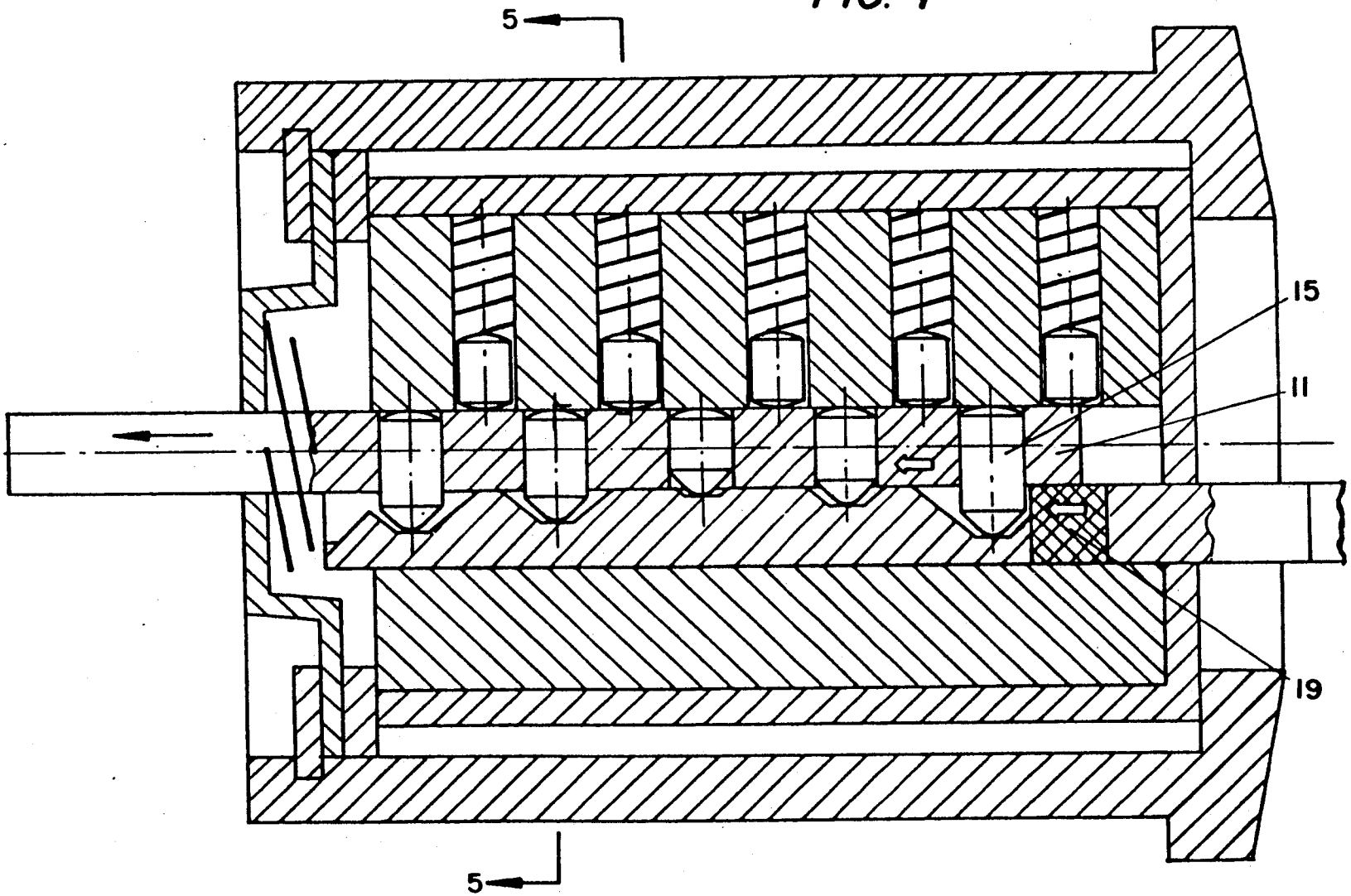
FIG. 4 is an elevational view partly in cross-section of the cylinder of the invention shown with the correct key inserted therewithin and pushed to the open position.
Figure 5:
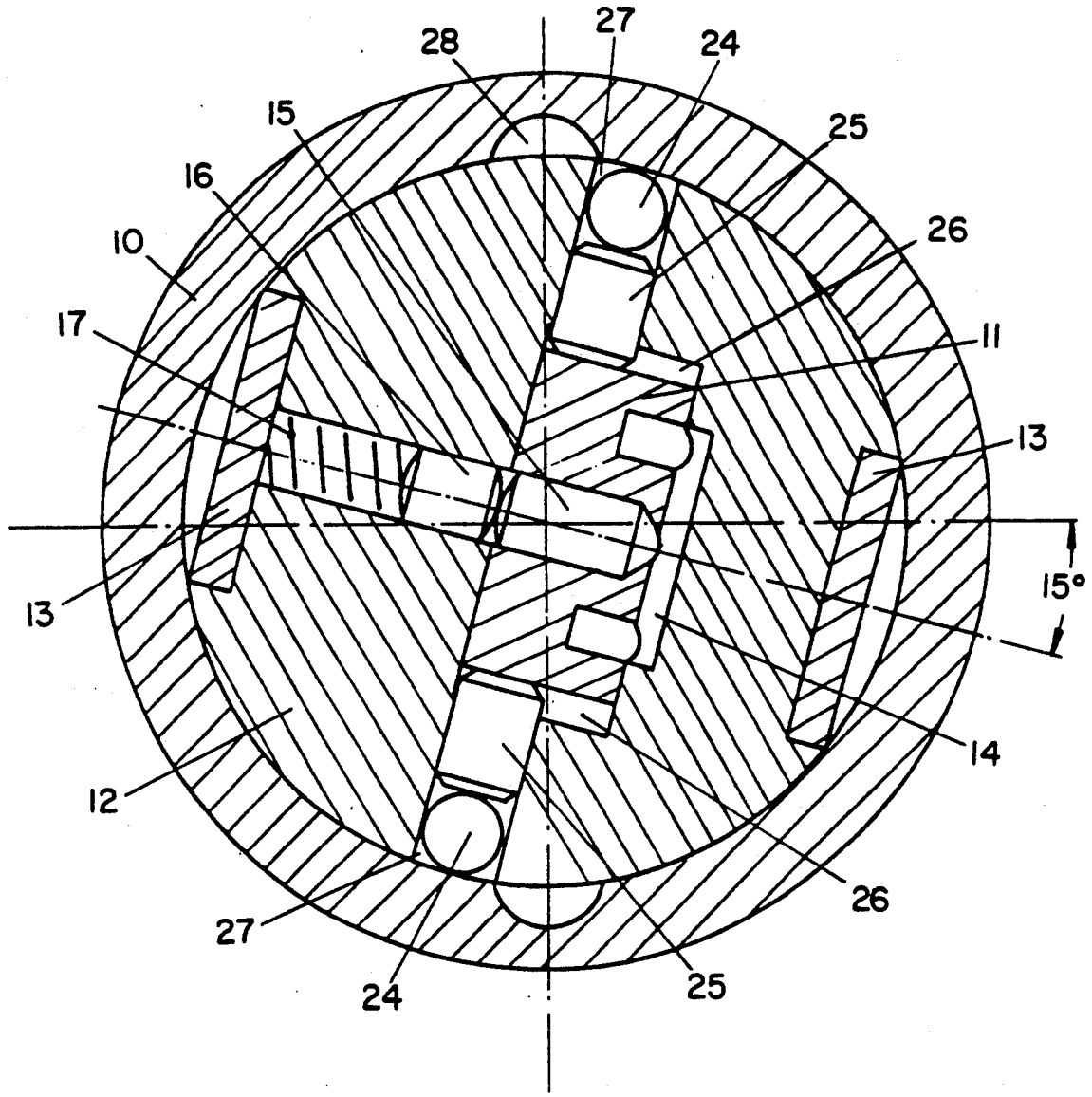
FIG. 5 is a view taken along line 5—5 of FIG. 4 and rotated clockwise 15 degrees.

FIG. 4 is a view similar to FIG. 1. However, key insert 19 has pushed pin 15 and hence flat slide plate 11 to the left. Thus key 14 has moved the flat slide plate 11 to an opening position. FIG. 5 is a cross-sectional view taken along line 5—5 in FIG. 4 and with the key turned 15 degrees to the right or clockwise.

Figure 7:
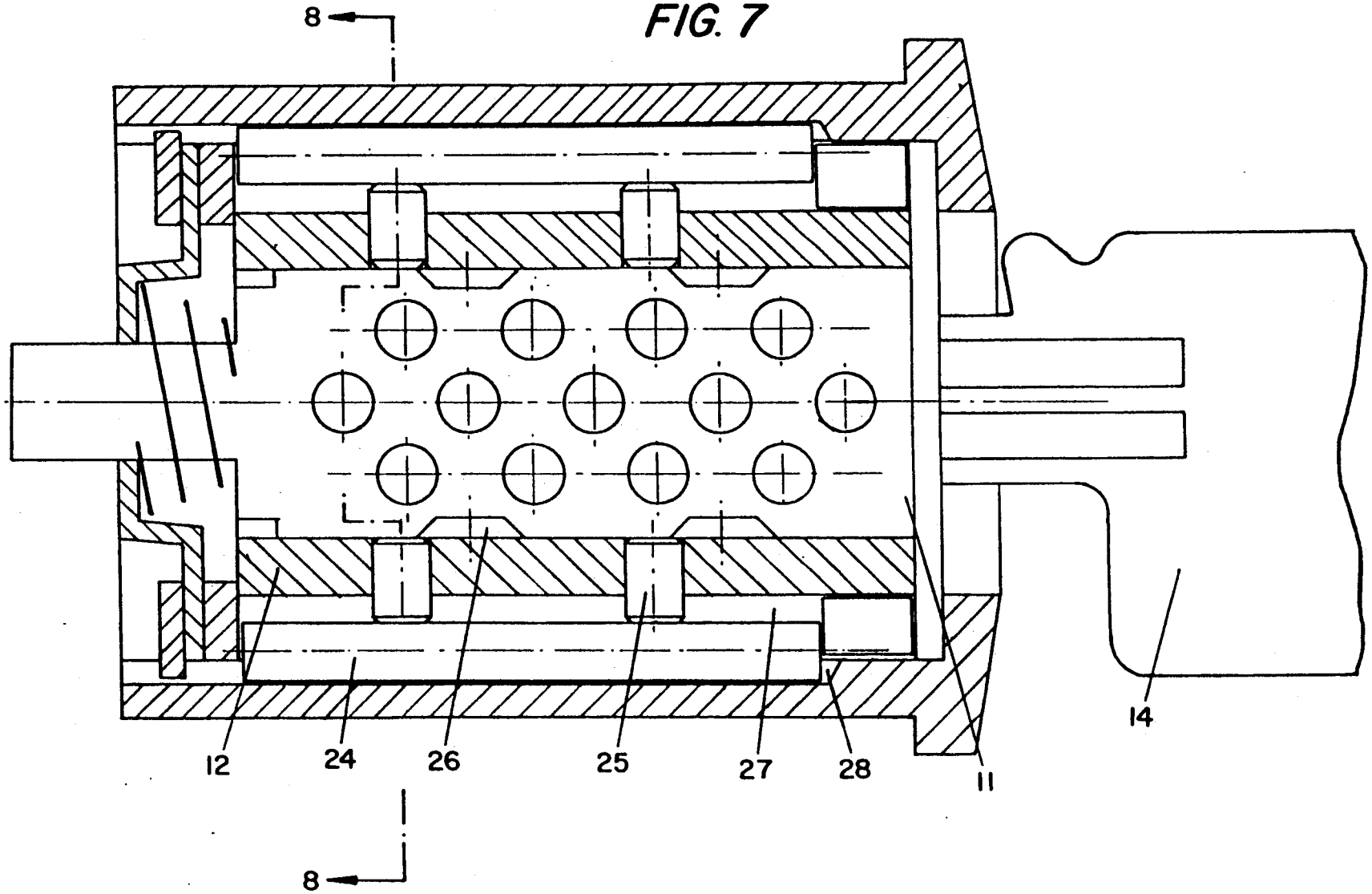
FIG. 7 is a top view partially in cross-section of the cylinder in accordance with the invention shown in a lock position with the correct key inserted therewithin and therefore corresponds to the configuration shown in FIG. 1.
Figure 8:
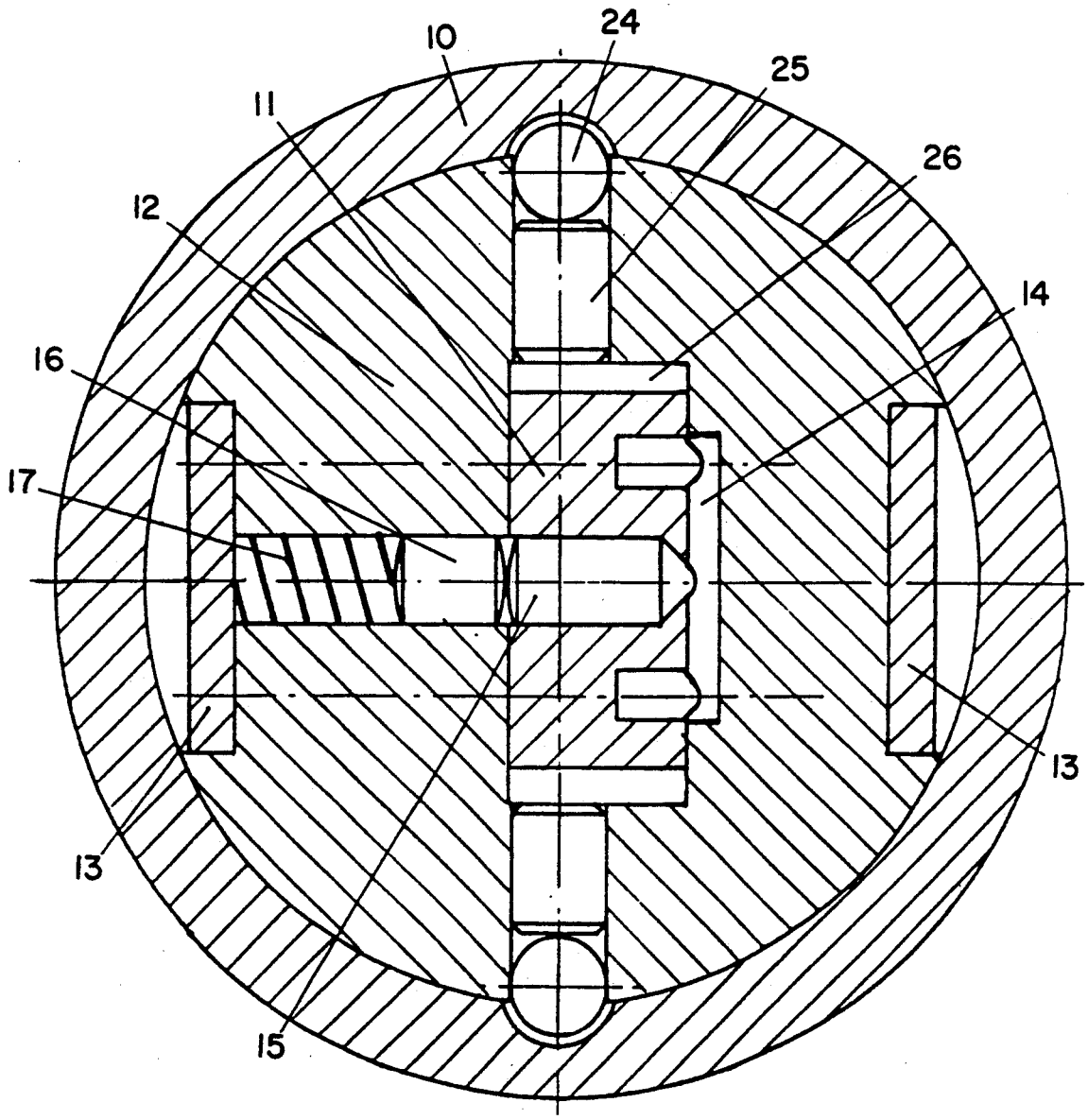
FIG. 8 is a view taken along line 8—8 of FIG. 7.

As shown in FIG. 7, prior to complete insertion of the key made possible by proper alignment of the pins and drivers 15, 16, and hence before flat slide plate 11 is moved from its lock to its open position, the side edges of flat slide bar 11 prevent side bar pins 25 from moving radially relative to rotatable body 12. Side bar pins 25 in turn prevent side bar 24 from moving into side bar rotatable body hole 27. Thus, side bars 24 which are partially disposed in side bar shell holes 28 prevent the rotation of rotatable body 12 relative to cylinder shell 10.

Figure 6:
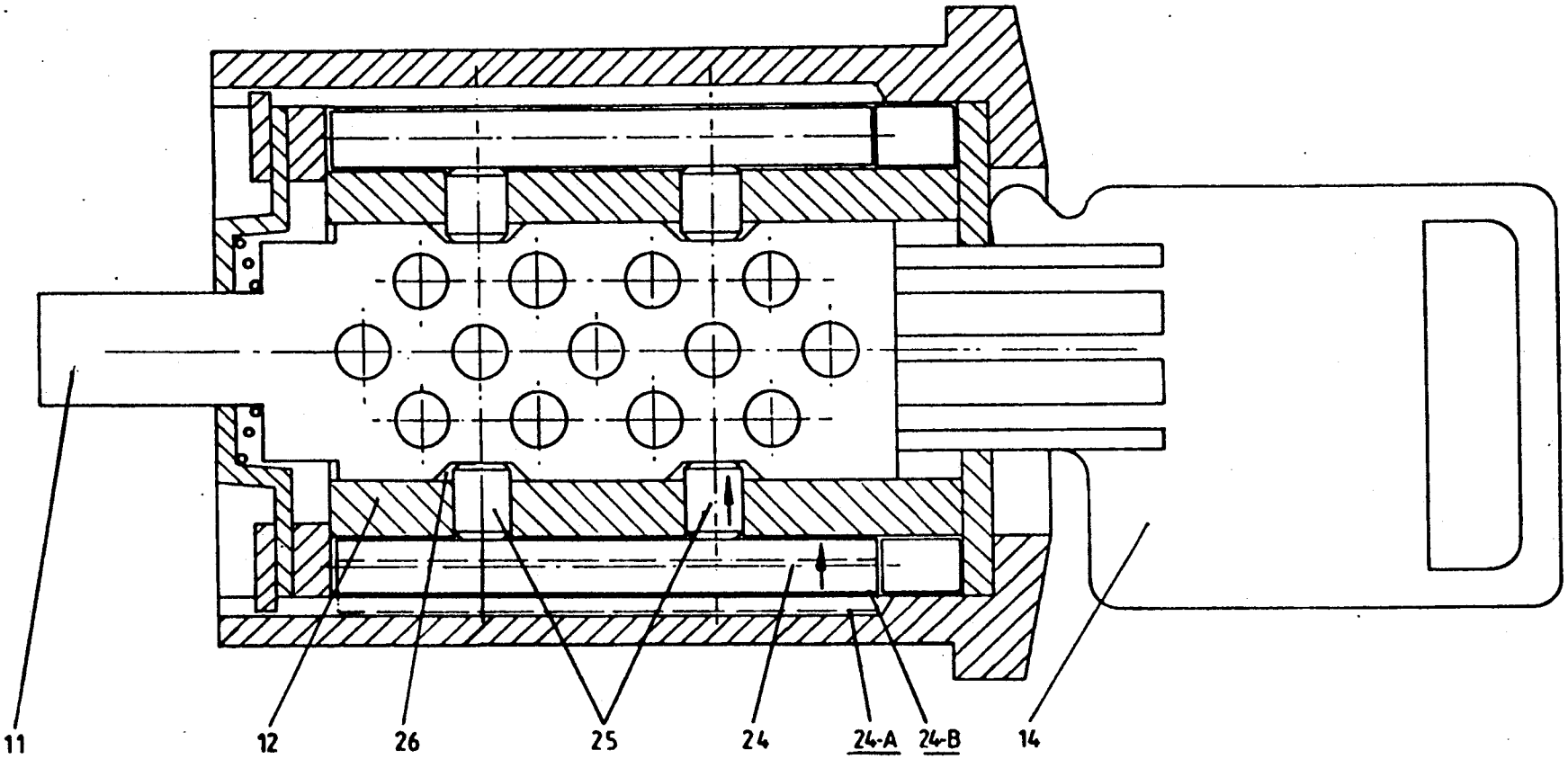
FIG. 6 is a top view partly in cross-section showing the correct key pushed to the open position within the cylinder.

As can be seen in the sequential key insertion views shown respectively in FIGS. 7, 6 and 5, when the correct or proper key 14 has been inserted into the cylinder lock and pushed to the open position, flat slide plate pin recesses 26 are aligned with side bar pins 25 so that it is possible for side bar 24 to enter the pin bar rotatable body hole 27 and thereby allow the main rotatable body 12 to rotate as key 14 is rotated. Such rotating movement of the cylinder rotatable body 12 is transferred to movement of the lock.

FIG. 9 shows an alternate embodiment of the invention wherein a plurality of side bar shell holes 28 are defined about the circumference of the locking cylinder. As is apparent from the description above, full insertion of the proper key and turning the rotatable body 12 pushes the side bar 24 from the side bar shell hole 28 into the side bar rotatable hole 27. The rotatable body 12 is then free to continue rotating and can transfer the rotation of the key to the lock mechanism (not shown). By adding additional side bar shell holes 28 as shown in FIG. 9, it is possible to open the cylinder and then close it in any of a plurality of positions. The foregoing is a particularly unique and advantageous characteristic of the locking cylinder of the invention.

A further alternative embodiment in accordance with the present invention is shown in FIGS. 10 and 11. As can be seen, a side bar ball 25.1 is provided in lieu of side bar pin 25. Indeed, in accordance with the present invention, a ball element can be substituted for the aforementioned pin elements without altering the function or advantageous features of the lock of the present invention.

Figures 12, 13, 14:
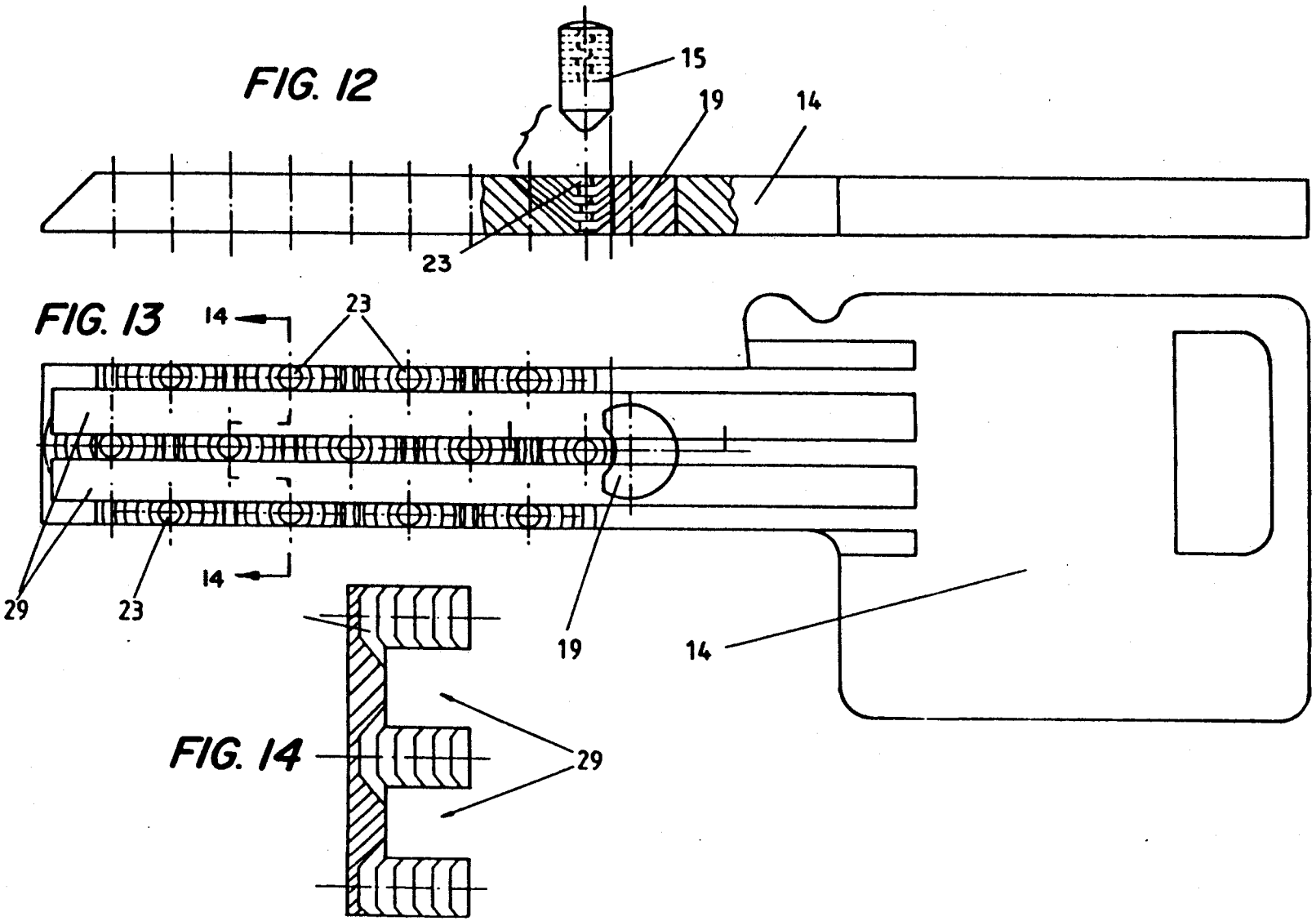
FIG. 12 is a side elevational view partly in cross section of a key in accordance with the invention.
FIG. 13 is a top plan view of the key shown in FIG. 12.
FIG. 14 is a cross-sectional view taken along line 14—14 of FIG. 13.
Figures 15, 16:
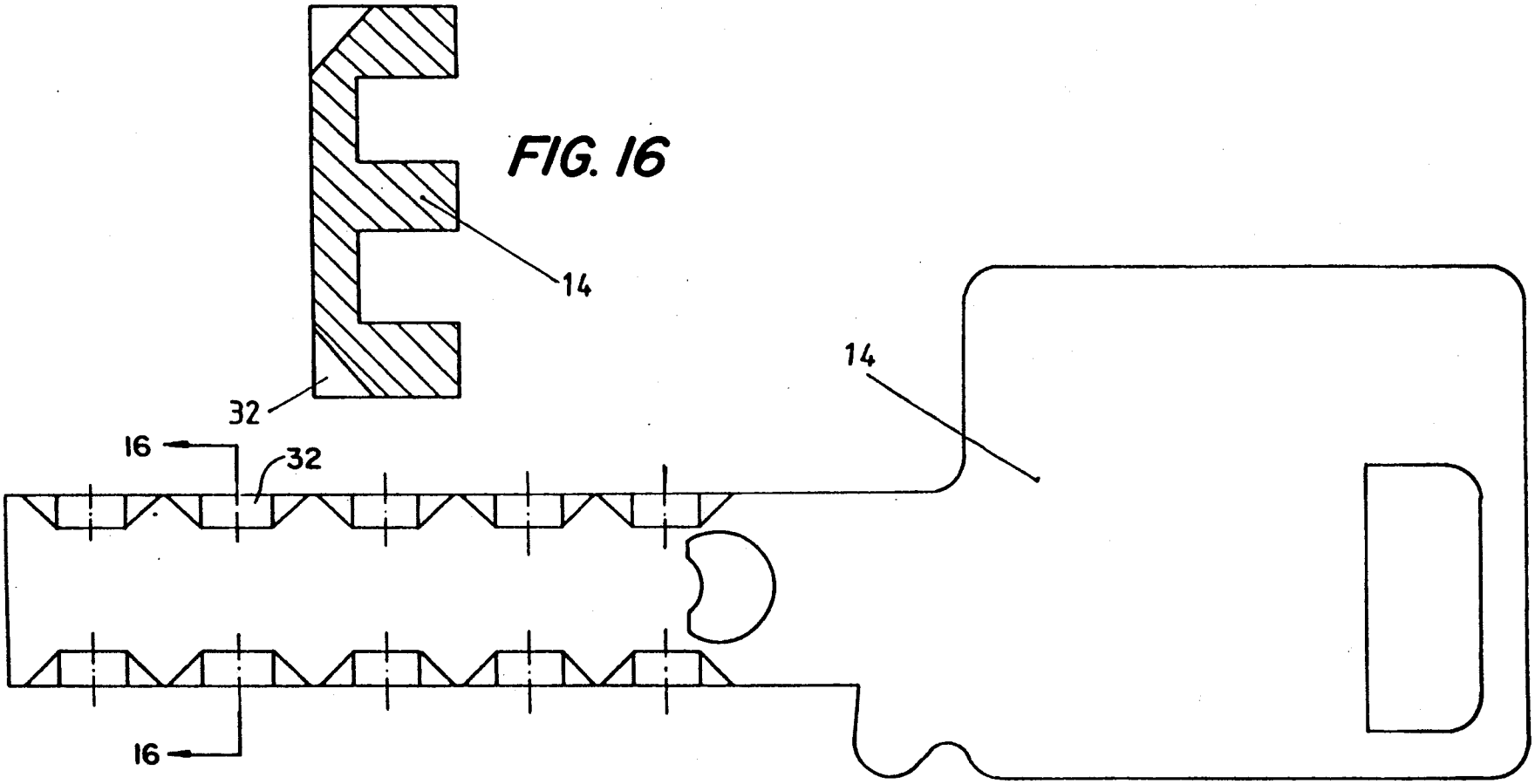
FIG. 15 is a bottom plan view of the key in accordance with the invention showing the key locking pin recesses.
FIG. 16 is a cross-sectional view taken along line 16—16 in FIG. 15.

FIGS. 12–14 show a key 14 provided in accordance with the present invention.

As can be seen, a plurality of bitings 23 are provided, each related to a pin tumbler 15. Key ways 29 are also defined along the length of the key. As shown in particular in FIGS. 12 and 14, in accordance with an example of the invention, seven different circular depths can be selected for each of the 13 bitings 23. If seven different depths are defined for the system and can be selected for each biting, then there are seven different combinations for the first biting, $7\times7$ or 49 for the second, $7\times49$ for the third, etc. to the 13th biting. Thus, there would be a total of 96,889,000,000 different key combinations possible. Ten further different combinations can be added as shown in FIGS. 15–18 and described more fully below, in order to assist master keying. Thus, the total number of key combinations for the illustrated embodiment will be 968,890,000,000.

Figure 17:
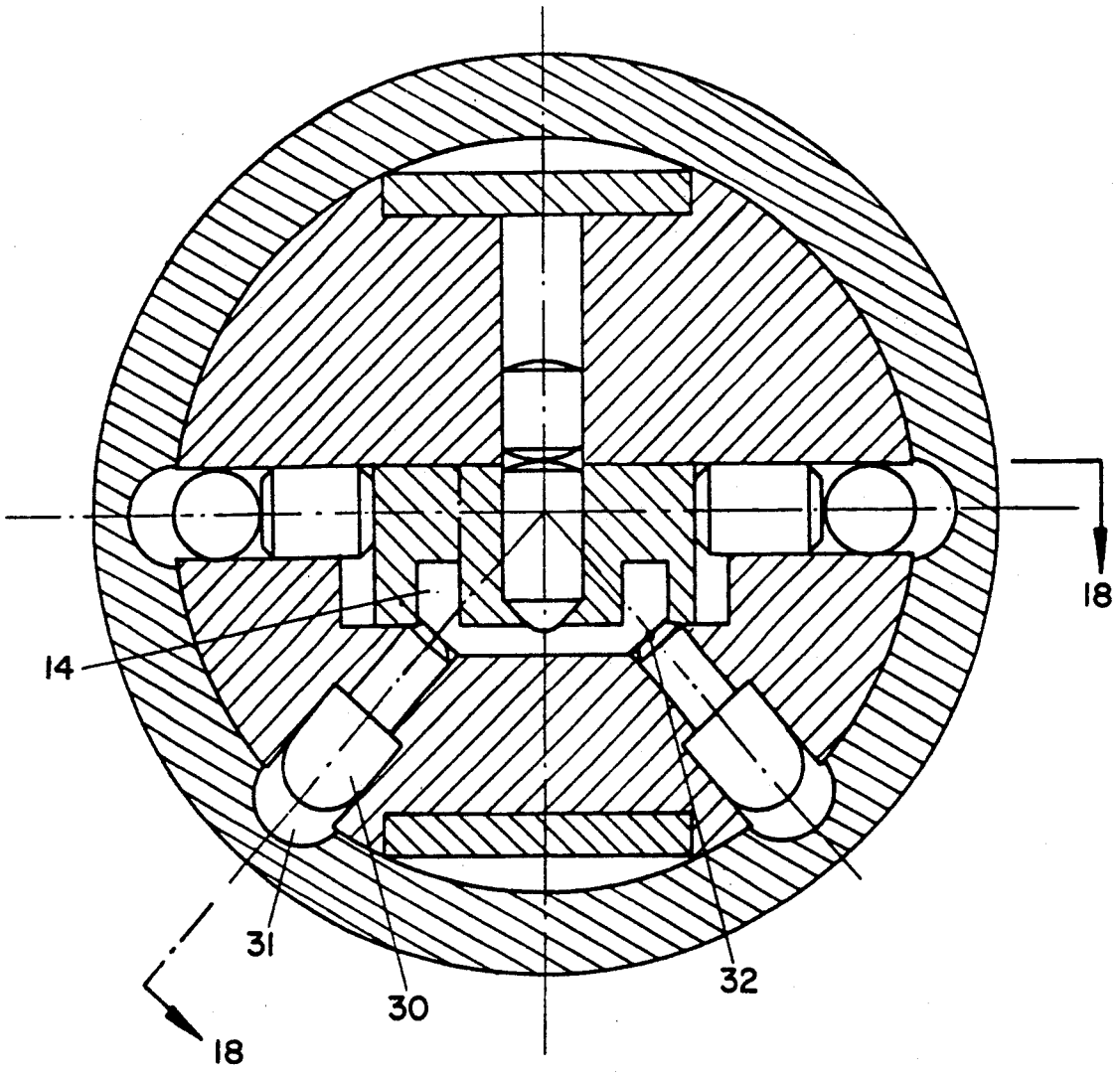
FIG. 17 is a sectional view of a cylinder provided in accordance with the present invention showing pins.
Figure 18:
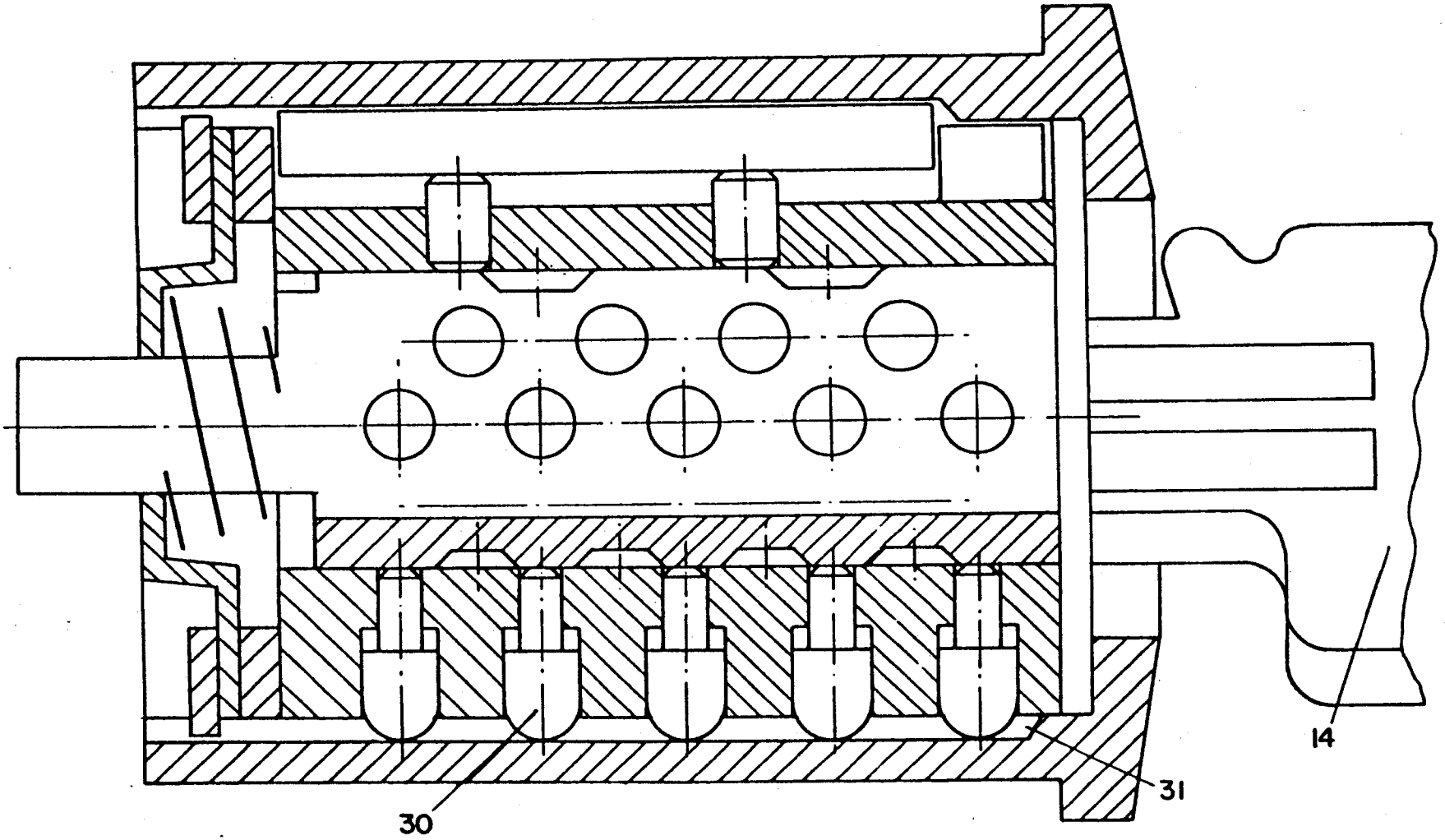
FIG. 18 is a cross-sectional view taken along line 18—18 of FIG. 17 but prior to full insertion of the key.

With reference to the structure shown in FIGS. 15–18, in accordance with a further aspect of the invention, key locking pin recesses 32 can be defined on the lower side edges of the key 14. Thus, as shown in FIG. 17, locking pins 30 can be added to the cylinder of the invention which engage side locking pin shell holes 31. Complete insertion of the proper key, then, will align pins 30 with recesses 32 which allow pins 30 to be displaced from shell holes 31 upon rotation of the key and hence allow corresponding rotation of the rotatable body 12. Providing a structure in accordance with the invention and including the details of FIGS. 15–17, then, can be equally provided with a master key,. a grand-master key, and a grand-grand-master key.

In the illustrated embodiment, a sliding movement is used to liberate the two side bars. Nevertheless, the slide movement could be used in a different way in order to liberate another kind of locking mechanism such as a back plate, in order to allow the rotatable body to rotate relative to the shell. The cylinder provided in accordance with the present invention can be provided with one or more locking pins. Of course, the key must be provided with a corresponding number of key locking pin recesses so that the locking pins can reach their opening position.

The key provided in accordance with the present invention must also include at least one key insert or means for urging the slide plate from its lock position to its open position upon insertion of the proper key. Indeed, if only one pin tumbler or one row of pin tumblers is provided, only one key insert can or need be provided. If more than one row of pin tumblers is provided, then one or two or more key inserts may be provided on the key. Of course, the number of key inserts provided should not exceed the number of pin tumbler rows provided within the locking cylinder. In that regard, if only a single key insert is provided, it can be located in front of any row of pin tumblers.

As is apparent from the foregoing, the lock cylinder of the invention will reach its opening position only if the correct key is in place within the cylinder However, this is insufficient to reach the final opening position. Indeed, in addition, at least one key insert must push the slide plate, for example by pushing a pin tumbler, so that the final opening position is reached. The combination of the required alignment of all pins and the requirement that one of the pins, for example, must be pushed to displace the flat slide plate makes it virtually impossible to open the lock cylinder of the invention by any means other than the proper key. Indeed, if the lock cylinder is locked, it is technically impossible to introduce a vibration device to align the pins while at the same the same time pushing a pin. Furthermore, even if such simultaneous alignment and pushing were possible, it should be understood that the repeated vibrations of the lock cylinder will cause the locking pins to jump up and down from locking to open positions making picking virtually impossible.

In this regard, furthermore, the locking pins in accordance with the invention, as well as the tumbler pins can be formed from different materials such as brass, steel, nickel-silver, copper, plastic and the like. Forming the locking pins and pin tumblers of different materials makes the pins jump during vibration at different rates. As such, there will virtually always be at least one pin in its locking position thereby preventing picking of the cylinder lock.

In summary, in order for the locking cylinder of the invention to be opened, at the same instant all the pin tumblers must be properly aligned, including the pin to be pushed, and all locking pins must be in their open position.

While the invention has been described in connection with what is presently considered to be the most practical and preferred embodiment, it is to be understood that the inventions not limited to the disclosed embodiment, but, on the contrary, is intended to cover various modifications and equivalent arrangements included within the spirit and scope of the appended claims.

What is claimed is:

1. A lock comprising:

a housing having a longitudinal axis, first and second ends, and means defining an aperture through one of said ends for receiving a key;

a main rotatable body mounted for rotation within said housing, said main rotatable body having a bore defined therein for receiving a key inserted through said aperture in said one end of said housing;

a flat slide plate slidably mounted within said rotatable body so as to be longitudinally slidable with respect thereto from a first, locking position to a second, opening position, said flat slide plate being mounted within said rotatable body so that a key inserted through said aperture in said one end of said housing and into said bore of said rotatable body will be disposed in immediately adjacent, parallel relation to said flat slide plate;

at least one bore defined through said flat slide plate along an axis disposed substantially perpendicular to a plane of said flat slide plate;

a tumbler element slidably disposed in each said bore of said flat slide plate, each said tumbler element being displaced upon insertion of a key configured for unlocking said lock from a position wherein longitudinal movement of said flat slide plate relative to said rotatable body is prevented to a position wherein longitudinal sliding movement of said flat slide plate relative to said rotatable body is permitted;

at least one recess defined in a lateral side edge of said flat slide plate, a corresponding bore for each said recess defined in said rotatable body, and side bar pin means slidably disposed within said corresponding bore, said corresponding bore and said recess being defined such that when said flat slide plate is disposed in said first position, said corresponding bore and said recess are offset from one another along said longitudinal axis of said housing, and when said flat slide plate is in said second position, each said corresponding bore is aligned with each said recess so that said side bar pin means can be displaced within said bore into engagement with said recess, whereby when a key for unlocking said lock is inserted through said aperture in said one end of said housing and into said bore of said rotatable body and engages each said tumbler element, each said tumbler element is aligned to allow longitudinal displacement of said flat slide plate and further insertion of said key longitudinally displaces said flat slide plate, whereby each side bar pin means can enter each said recess upon rotation of said key about said longitudinal axis to thereby allow rotation of said rotatable body as said key rotates to actuate a locking mechanism of the lock.

2. A lock as in claim 1, further comprising a side bar housing hole defined on an interior surface of said housing aligned with each said corresponding bore and said side bar pin means, said side bar hole receiving said side bar pin means when said flat slide plate is in said first position to thereby prevent rotation of said rotatable body relative to said housing.

3. A lock as in claim 2 therein said side bar pin means comprises a side bar pin element and a side bar, said side bar pin element being slidably disposed within said corresponding bore in said rotatable body, a side bar rotatable body hole being defined in an exterior surface of said rotatable body and being aligned with said side bar housing hole prior to rotation of said rotatable body from a lock to a unlock position, said side bar being selectively disposed in said housing hole and in said rotatable body hole in accordance with a position of said side bar pin element and angular disposition of said rotatable body and said housing.

4. A lock as in claim 2, comprising a plurality of side bar housing holes defined about the periphery of said housing so as to define a plurality of lock positions of said rotatable body.

5. A lock as in claim 1, wherein each said tumbler element includes a pin tumbler and a driver, said driver being disposed within a bore defined in said rotatable body and being spring urged into engagement with a respective pin tumbler, alignment of an engagement surface of said driver and an engagement surface of said pin tumbler with an interface between said rotatable body and said flat slide plate allowing longitudinal displacement of said flat slide plate between said first position and said second position.

6. A lock as in claim 2, wherein said side bar pin means includes a ball element slidably mounted within said corresponding bore in said rotatable body.

7. A lock as in claim 1, further comprising at least one locking pin, each locking pin being disposed in a radial bore of said rotatable body and being slidable with respect thereto, and a corresponding locking pin housing hole defined in said housing for engaging an end of said locking pin to prevent rotatable movement of said rotational body relative to said housing when displacement of said at least one locking pin within said bore toward said key receiving bore in said rotatable body is prevented.

8. A lock as in claim 1 in combination with a key having at least one biting defined in a surface thereof for receiving each said tumbler element.

9. The combination of claim 8, wherein said key further includes a key insert for urging said flat slide plate to slide longitudinally relative to said rotatable body while engagement of said key with said at least one tumbler element allows longitudinal displacement of said flat slide plate.

10. A lock as in claim 7, in combination with a key having at least one biting defined in a surface thereof for receiving each said tumbler element, the key further comprising locking pin recesses for selective alignment, when said flat slide plate is in said second position, with said at least one radial bore in said rotatable body so as to allow displacement of said locking pin within said radial bore when a key for unlocking the lock is inserted into said key receiving bore to allow rotation of said rotatable body relative to said housing.

11. The combination of claim 10 wherein said at least one biting is defined in an upper planar surface of said key.

12. The combination of claim 10, wherein said locking pin recesses are defined in a lower planar surface of said key.

* * * * *